United States Patent [19]

Brandon

[11] 4,398,575

[45] Aug. 16, 1983

[54] FILLER TUBE WITH CHECK VALVE FOR CONTAINER FILLING DEVICES

[75] Inventor: Harold J. Brandon, Festus, Mo.

[73] Assignee: Barry-Wehmiller Company, St. Louis, Mo.

[21] Appl. No.: 277,811

[22] Filed: Jun. 26, 1981

[51] Int. Cl.[3] ..... B65B 3/26; B65B 31/00

[52] U.S. Cl. ..... 141/39; 141/57; 141/303

[58] Field of Search ..... 137/202, 199, 197; 141/6, 39, 40, 46, 198, 301-303, 308, 392, 57

[56] References Cited

U.S. PATENT DOCUMENTS

| | | | |
|---|---|---|---|
| 1,022,968 | 4/1912 | Neumayer . | |
| 2,770,263 | 11/1956 | Breeback | 141/6 |
| 3,067,785 | 12/1962 | Meyer | 141/57 |
| 3,090,408 | 5/1963 | Naecker | 141/57 |
| 3,192,966 | 7/1965 | Breeback | 141/56 |
| 3,674,061 | 7/1972 | Calisher et al. | 137/202 X |
| 3,732,902 | 5/1973 | Muller | 141/198 |

*Primary Examiner*—Frederick R. Schmidt

*Attorney, Agent, or Firm*—Gravely, Lieder & Woodruff

[57] ABSTRACT

A container filling device having an arrangement of liquid and gas flow control valves in a common body that separates the flow of the liquid and gas without need for seals, and incorporating in the filling device a valve element in a cage supported from a gas flow vent tube, whereby turbulence is minimized and filling is speeded up.

2 Claims, 6 Drawing Figures

FIG. 3
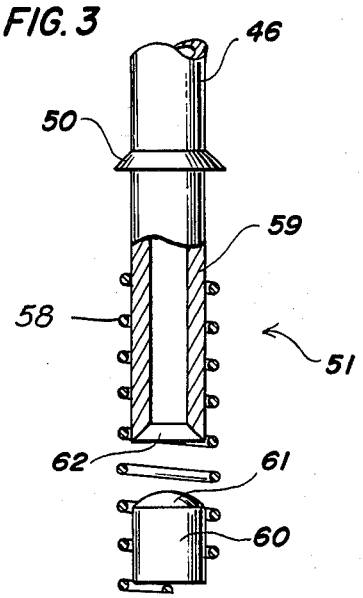
FIG. 4
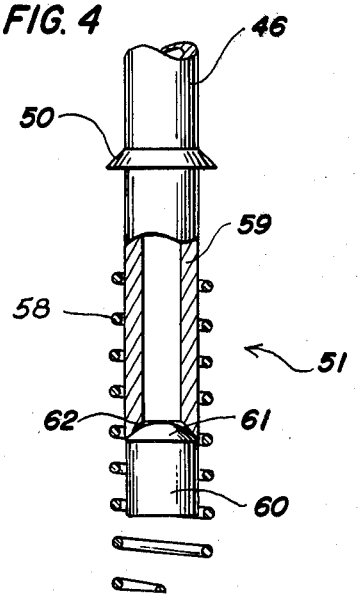
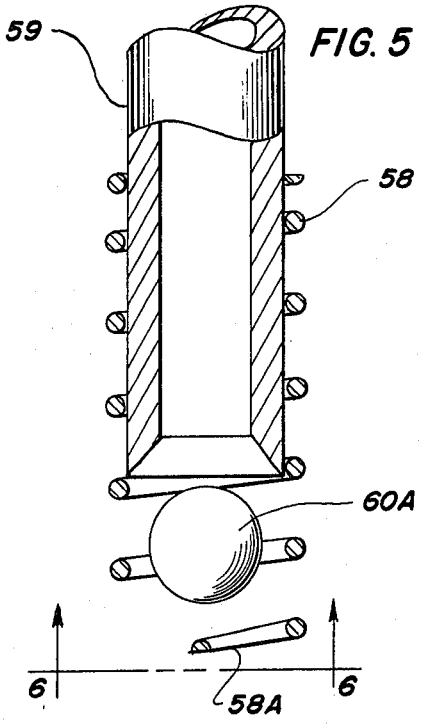
FIG. 5
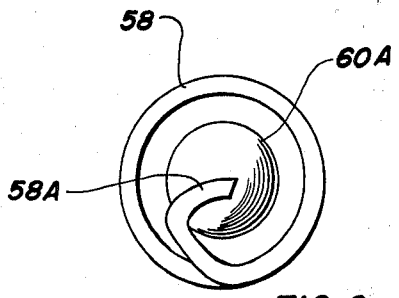
FIG. 6

FILLER TUBE WITH CHECK VALVE FOR CONTAINER FILLING DEVICES

BACKGROUND OF THE INVENTION

1. Field of the Invention

This invention relates to short tube container filling devices having a check valve cooperating with the tube inlet to minimize flow disturbances and to prevent tube purging during the container filling operation.

2. Description of the Prior Art

Short tube filling devices are in common use in the filling of containers in soft drink bottling machines, as well as in breweries. In devices of this class, the short tube extends a short distance into the bottle or container during the process of admitting a beverage, such as a soft drink, beer or the like, to the container. The tube is provided for admitting a pressurized gas to the container in advance of the beverage so that the entry of the beverage can proceed by gravity influence and the charging gas can exit through the tube at high speed and with a minimum of frictional resistance.

The prior art includes such devices as disclosed in Meyer U.S. Pat. No. 3,067,785 of Dec. 11, 1962 and pertaining to a hollow stem having a ball check valve suspended adjacent the mouth of the stem by a rigid cage. A similar arrangement of tube and check valve device is shown in Breeback U.S. Pat. No. 2,770,263 of Nov. 13, 1956. Additional disclosures of ball check valves in short filling tubes can be seen in Naecker U.S. Pat. No. 3,090,408 of May 21, 1963, in Breeback U.S. Pat. No. 3,192,966 of July 6, 1965, and in Neumayer U.S. Pat. No. 1,022,968 of Apr. 9, 1912.

A problem with the foregoing types of ball check valves for a filling tube is the total pressure loss associated with the form of the inlet passage. The tube inlet has been found not to allow the gas to enter the tube in a smooth stream. This is undoubtedly due to the high friction losses created by the configuration of the inlet. The result of such losses is that the filling speed can be decreased compared to a simple open-ended tube. If a check valve is omitted, then the beverage will flow up into the tube, and on the next filling sequence that quantity of beverage will be forced into the next container with a considerable degree of violence. The end result is that certain beverage products can be caused to go "wild", resulting in a longer snift time and loss of product through foaming, as the container is removed from the sealing cup.

The ball check valves of the prior art do not achieve the smooth escape of the gas so that the filling cycle consumes more time. In view of this there is a residue of product in the tube which is blown into the next bottle which affects the next filling cycle by reason of the small droplets of product being blown into the next container to cause excessive foaming.

SUMMARY OF THE INVENTION

The foregoing problems encountered in prior art devices are significantly overcome by reducing the friction losses in the gas flow through the filler tube by shaping the inlet mouth of the tube and capturing the check valve in a cage presenting a minimum of obstruction to the gas flow into and out of the container.

The objects of the invention are to increase the speed of container filling, avoid the loss of product through reducing foaming and presenting a shaped check valve to the rising level of product so it can seat in the filler tube mouth as early as possible to reduce loss of product in the purge step.

BRIEF DESCRIPTION OF THE DRAWINGS

A preferred embodiment of the present invention is shown in the accompanying drawings, wherein:

FIG. 3 is a fragmentary view of the vent tube and check valve in operative position for admitting charging gas to the container;

FIG. 4 is a view similar to FIG. 3 but with the check valve in closed position at the mouth of the filler tube;

FIG. 5 is a view of a modified filler tube and check valve assembly; and

FIG. 6 is a view taken along line 6—6 in FIG. 5.

DETAILED DESCRIPTION OF THE EMBODIMENTS

Figure 1:
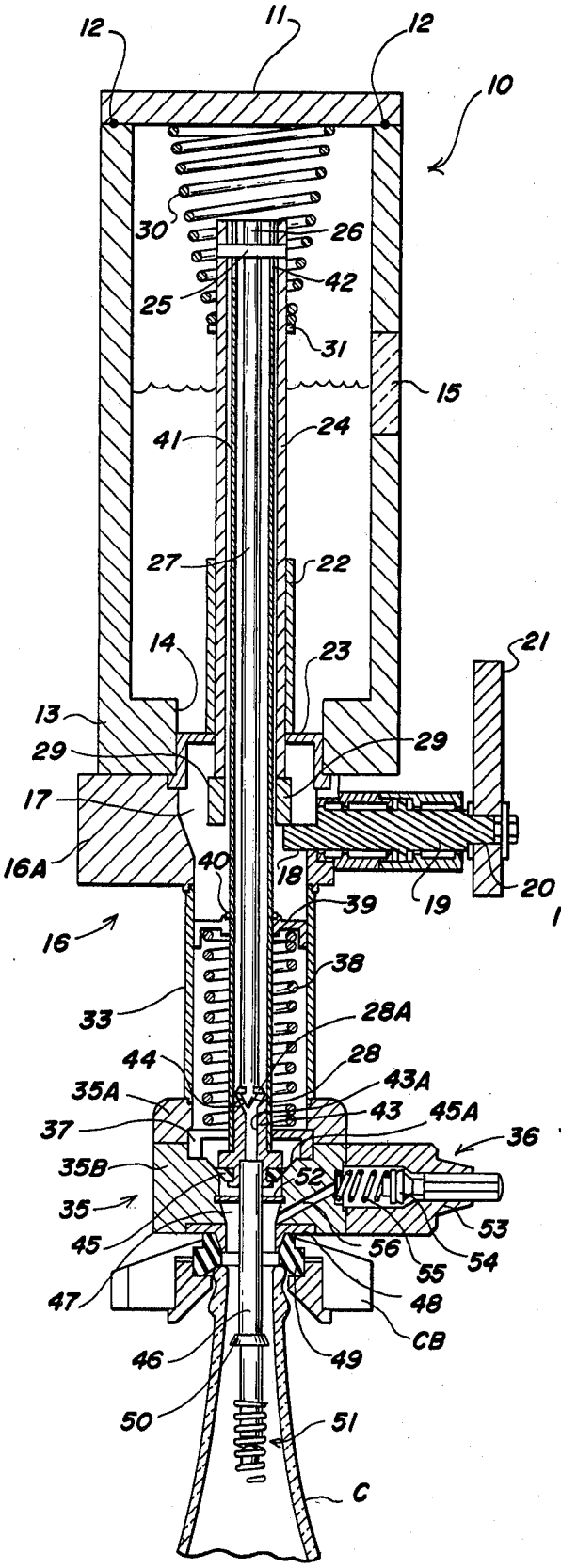
FIG. 1 is a longitudinal section through a typical counter-pressure container filler valve assembly in which the present filler tube with a check valve is shown in its gas charging position.

In FIG. 1, the present embodiment, while shown in its normal no liquid flow condition, comprises a bowl 10 having a top closure 11 sealed by elements 12. The bottom wall 13 of the bowl is formed with an outlet opening 14. A sight glass 15 is mounted in the bowl wall so the level of the liquid may be checked as found necessary. The space above the liquid level is pressurized with a suitable gas, such as carbon dioxide or carbon dioxide and air mixture.

The filling valve assembly 16 arrangement comprises a base **16*a* secured over the outlet opening 14 in the bowl 10. The base 16*a* has a liquid passage 17 therein, and at one side of that passage an operating cam 18 is located. The cam 18 is carried by a shaft 19 having suitable seals, and the exterior end 20 is engaged by a lever 21 which moves with the rotation of the bowl 10 and is suitably actuated to cause the cam 18** to operate for the purpose of controlling the admission of the pressurizing gas to a container, as will presently appear.

The valve assembly 16 includes a guide 22 supported on a spider ring 23 projecting from the base **16*a* into the bottom outlet opening 14 such that the guide 22 projects into the body of liquid in the bowl 10. An outer or primary sleeve 24 is mounted in the guide 22 so its lower end reaches into the space adjacent the support spider 23. The outer or upper end of the primary sleeve extends above the level of the liquid in the bowl 10 so its open end is exposed to the pressurizing gas. The primary sleeve 24 supports a pin 25 which engages in the adjacent upper end 26 of a rod 27 suspended by the pin 25 inside the primary sleeve 24. The rod passes well below the bottom of the primary sleeve 24 to a bottom end in the form of a shaped valve 28**, the purpose of which will be explained presently.

The base **16*a* supports a fork element having tines 29 straddling the rod 27 so as to engage the bottom end of the primary sleeve 24. One of the tines 29 also engages on the cam 18 for the purpose of being able to actuate the fork element so the primary sleeve 24 can be elevated. Rather than rely on gravity to hold the primary sleeve engaged on the fork tines 29, there is a spring 30 in the upper area of the bowl 10 engaged at one end on an abutment 31 fixed to the primary sleeve 24 and engaged on the under side of the cover 11 at its opposite end. Thus the reciprocation of the primary sleeve 24 in the guide 22 is effected by the cam 18 and the spring 30. During reciprocating movement of the primary sleeve 24, the rod 27** will be moved in like manner.

The base 16*a* secured to the bottom outlet 14 of the bowl 10 supports an extension member 33 and the lower end of the member 33 supports the upper part 35*a* of a container filling head 35. These parts 16*a*, 33 and 35*a* are welded or otherwise secured together as a subassembly. As shown the filling head 35 includes a second part 35B which is separate so a number of functional elements located internally of the head may be assembled. Snift valve 36 is supported by part 35B. The part 35A is counterbored to receive a spider element 37 which acts as an abutment for the lower end of a spring 38, the upper end of the spring being engaged on a second spider element 39 which is slidable in the extension 33. The upper end of spider element 39 is secured by a suitable ring element 40 to the exterior of an elongated secondary sleeve 41. The secondary sleeve 41 has slots 42 therein which straddle the pin 25 connecting the rod end 26 to the primary sleeve 24 so the secondary sleeve 41 has movement independent of the primary sleeve 24.

The bottom end of the secondary sleeve 41 supports a body 43 which may be press-fitted in the sleeve 41 such that its inner conic end forms a seat surface 44 to receive the shaped valve 28 on the rod 27. A valve seal ring 28A is carried by the valve 28 so as to close the passage 43A in the body 43. The bottom end of the body 43 is enlarged so it can support a suitable valve ring 45 in position to engage on the bevelled seat 45A formed in the part 35B of the filler head 35. The body 43 supports the upper end of a gas vent tube 46 in position to extend through the passage 47 and through a support nipple 48 for a resilient ring 49 which is engaged by any finish of a container C. The outer end of the vent tube carries a liquid spreader element 50 above a vent control valve assembly 51. A suitable screen 52 may be supported in the passage 47 below the seat surface 45A. A conventional centering bell C.B. is used to position and locate the container in proper relation to the valve assembly 51.

The snifter valve 36 includes a valve body 53 for a valve 54 which is pressed into normal closed position by resilient element 55. The cavity in the body 53 is in communication through a passage 56 with the passage 47, and upon pressing on the valve rod 57, the passage 47 is opened to ambient space as the valve 54 is unseated.

In FIG. 3, the vent tube valve assembly 51 comprises a coil spring 58 slidably received over the end 59 of the vent tube 46 below the spreader 50. The turns of the spring may be slightly enlarged during the assembly so that when relaxed they will close about the tube end 59 in a frictional embrace. The spring 58 extends below the end 59 of the vent tube 46 to provide an open space or open cage in the coils. A shaped valve element 60 is captured in the open space of the spring coil. The element 60 is shaped in the form of an elongated plug having a blunt-rounded end 61 to mate with a shaped seat 62 surrounding the open end of the vent tube 59. The coil turns, beyond said tubular portion, have a terminal end 58A closing the cage area to escape of the valve element.

Figure 2:
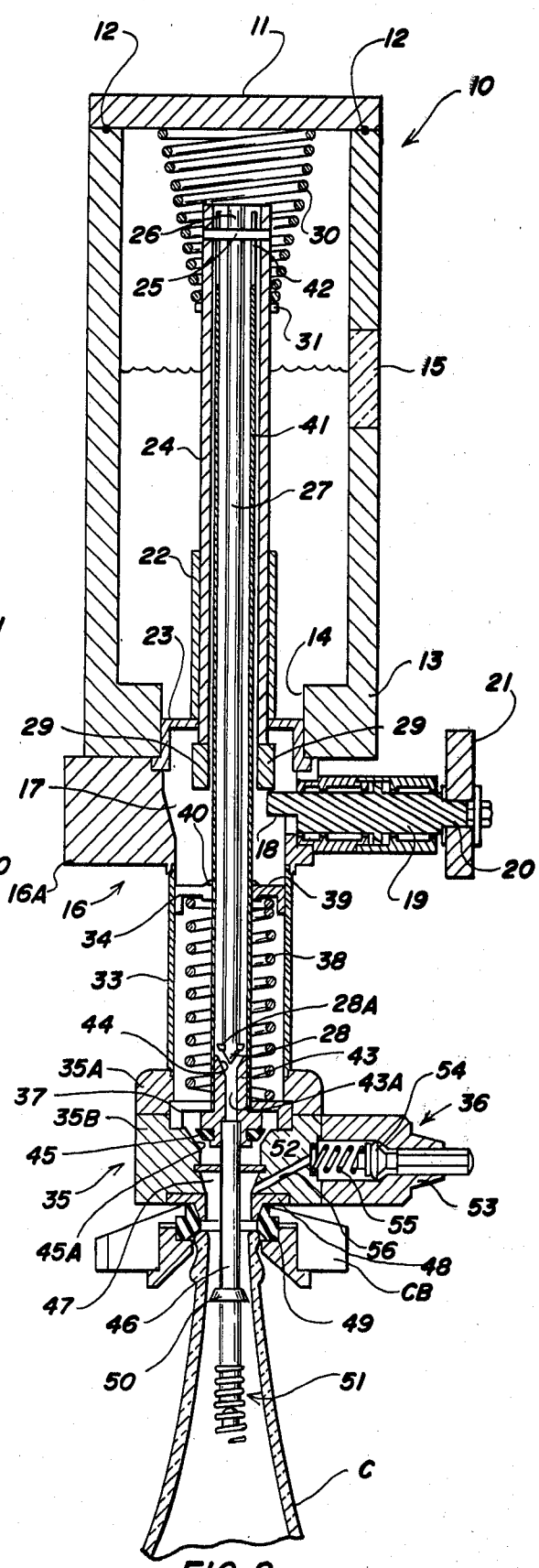
FIG. 2 is a view similar to FIG. 1 but in which the filler tube and check valve is operative to allow the liquid product to enter the container while the gas is being forced out.

Comparing FIGS. 1 and 2, it can be seen that when the lever 21 is actuated to rotate cam 18 and raise the primary sleeve 24, the rod 27 is raised and its valve end 28 is lifted off the seat 44 in body 43 at the end of the secondary sleeve. The gas in the space above the liquid in bowl 10 is released to flow through the secondary sleeve 41 and through the vent tube 46 and the vent control valve assembly 51 into the container C. During this time, and even before, liquid is forced to fill the extension 33 above the control valve 45. When the pressure condition in the container C is equal to the pressure of the liquid at the valve 45, the resilient spring 38 is able to lift the spider 39 and raise the secondary sleeve 41. The raising of the latter sleeve 41 lifts the valve 45 off seat 45A and liquid is released to flow by gravity from the bowl 10 into the container C. As the liquid rises in container C, the gas is displaced rapidly and with a minimum of turbulance upwardly through the vent tube 46. The exchange of liquid for the gas in the container C occurs very rapidly which is desirable to shorten the time required to fill a container.

When the gas is displaced rapidly by liquid entering the container the weight of the element 60 does not allow it to close on the seat 62 while the gas flows smoothly into the entrance of the vent tube end 59. However, as the liquid rises it enters the open space in the spring coil and tends to lift the element 60 to a position where the Venturi effect of the gas flow will pick up the element 60 and move it into a position engaged on the seat 62 to stop further gas venting. When in the raised position the differential pressure holds the element 60 in raised position. The liquid will continue to rise until the pressure in the neck area outside the vent tube 46 equals the pressure acting on the liquid from the bowl. The pressure creates surface tension on the liquid on the screen and stops flow by balancing the liquid on the screen. At the proper time, lever 21 will be operated to rotate cam 18 so the spring 30 can lower the primary sleeve and thereby return the rod 27 so its lower end 28 engages seat 44 in body 43 to close the gas passage through the secondary sleeve 41. When this occurs, the pressurized liquid in the extension will force the valve 45 to engage its seat 45A. The final step is for the snifter valve 36 to be actuated to open the passage 56 to the ambient area and allow escape of the small quantity of gas which has been trapped in the container neck, and the area of the vent tube under the gas seat 44 until the pressure is reduced to atmospheric level.

The foregoing improvement is directed to a control valve assembly 51 which can be mounted on existing filling apparatus having gas vent tubes, as well as with the improved filling assembly herein. The configuration of element 60 is important as it can be weight modified in several ways as required by the character of the liquid and by the desired responsive movement when it is moved into the Venturi effect of the gas flow through the vent tube 46 back to the bowl 10. For example, the element 60 can be formed of a material which adapts to weight modification as well as length changes to suit the required characteristics of the individual application to a filling apparatus.

In FIGS. 5 and 6 a modification is shown in relation to a ball 60A being captured within the coils of spring 58. When a ball element is used the spring 58 does not need to project beyond the vent tube end 59 as far as may be required for the shaped element 61. However, a ball imposes somewhat less resistance on the flow of gas into and out of the tubes end portion 59.

When employed to fill containers with potable liquids, the foregoing components of the apparatus should be formed of stainless steel or formed of a suitable non-corrosive material which has not influence on taste or on other aspects of the liquid.

What is claimed is:

1. In a container filler apparatus providing a source of a liquid product, a pressurizing medium and a connection between the source of liquid product and a container to receive the liquid product, the improvement of a valve assembly in said connection comprising:

(a) a filling head body formed with a passage for the flow of the liquid product toward the container, said flow passage being formed with a seat surface;

(b) sleeve means connecting said filling head body flow passage with the liquid product source;

(c) valve body means having an internal passage extending therethrough from a valve seat at one end of said internal passage, said valve body means being formed on its exterior with a valve for engaging on said flow passage seat surface;

(d) second sleeve means extending from the pressurizing medium source through said liquid product passage for connection to said valve body means, said sleeve means isolating the internal passage in said valve body means from the liquid product flow on the exterior thereof;

(e) pressurizing medium vent means connected to said valve body means to form a continuation of said internal passage in said valve body means;

(f) valve means operable in said sleeve means cooperating with said valve seat at said one end of said valve body means internal passage for selectively opening and closing said internal passage to the flow of pressurizing medium to said vent means; and (g) second valve means carried by said vent means in position to enter the container, said valve means having coiled means grasping the exterior of said vent means and extending therebeyond with open turns to form a cage, and a valve element captured in said cage but movable away from said vent means by gravity to admit pressurizing medium to flow into the container and movable to close said vent means to the reverse flow of pressurizing medium in response to the rise of liquid product in the container for closing said vent means to liquid product.

2. The improvement set forth in claim 1 wherein said valve body means has said exterior valve disposed adjacent the opposite end, and said vent means joins said valve body means adjacent said exterior valve and projects from said exterior valve toward the container through said liquid flow passage.

* * * * *